United States Patent [19]

Kajiwara et al.

[11] Patent Number: 4,583,026

[45] Date of Patent: Apr. 15, 1986

[54] LOW-PRESSURE MERCURY VAPOR DISCHARGE LAMP

[75] Inventors: Toshiro Kajiwara; Yoshinori Anzai; Takeo Saikatsu; Goroku Kobayashi; Hiroshi Yamazaki; Yoshiji Minagawa, all of Kamakura, Japan

[73] Assignee: Mitsubishi Denki Kabushiki Kaisha, Tokyo, Japan

[21] Appl. No.: 629,038

[22] Filed: Jul. 9, 1984

[30] Foreign Application Priority Data

Jul. 19, 1983 [JP] Japan ..... 58-131472
Jul. 19, 1983 [JP] Japan ..... 58-131473
Jul. 29, 1983 [JP] Japan ..... 58-138903

[51] Int. Cl.[4] ..... H05B 37/02

[52] U.S. Cl. ..... 315/226; 315/205; 315/208; 315/287; 315/DIG. 7; 323/223; 323/300; 363/133; 313/486; 313/576; 313/642

[58] Field of Search ..... 323/223, 299, 300; 363/97, 133; 313/490, 486, 572, 576, 621; 315/642, 287, 226, DIG. 7, 205, 208

[56] References Cited

U.S. PATENT DOCUMENTS

| | | | |
|---|---|---|---|
| 3,648,106 | 3/1972 | Engel et al. | 315/291 |
| 3,939,396 | 2/1976 | Larson | 323/223 |
| 4,042,856 | 8/1977 | Steigerwald | 323/299 |
| 4,170,747 | 10/1979 | Holmes | 315/287 |
| 4,525,648 | 6/1985 | DeBijl et al. | 363/97 |

*Primary Examiner*—Harold Dixon
*Attorney, Agent, or Firm*—Sughrue, Mion, Zinn, Macpeak and Seas

[57] ABSTRACT

A low-pressure mercury vapor discharge lamp comprises a tubular bulb having an inside diameter of from 22 mm to 35 mm, an electrode-to-electrode distance of from 400 mm to 1,200 mm, and an inner surface coated with a phosphor. A rare gas including Kr and a mercury vapor source are sealed in the bulb, which is energized by an igniting device having a high-frequency power supply connected to a DC power supply for generating a substantially sinusoidal high-frequency output voltage, and a quiescent period generator connected to the high-frequency power supply and including a switch 17 turned on and off at least once during each half cycle to provide a quiescent period and thereby produce a substantially square wave high-frequency output voltage having rise and fall times of 2 μs or less.

7 Claims, 9 Drawing Figures

(a)

(b)

LOW-PRESSURE MERCURY VAPOR DISCHARGE LAMP

BACKGROUND OF THE INVENTION

1. Field of the Invention

The present invention relates to a low-pressure mercury vapor discharge lamp having a sealed bulb filled with a rare gas of Kr and a mercury vapor source and having a phosphor-coated inner surface, and an igniting device for generating a high-frequency output voltage.

2. Description of the Prior Art

Low-pressure mercury vapor discharge lamps which are ignited by the application of a high-frequency voltage having quiescent periods are disclosed in Japanese Utility Model Registration No. 1,400,382. The discharge lamp described therein contains a mixed gas of 25% by volume of Ne and 75% by volume of Ar sealed at 25 mm Hg and mercury vapor sealed at $6\times10^{-3}$ mm Hg. The lamp is ignited by an electric igniting circuit composed of a four transistor bridge and an additional transistor connected in series with the bridge for applying a square-wave voltage having a duty cycle ranging from 35% to 65% to reverse the direction of current flow each time a voltage pulse is applied. When the lamp is energized at the frequency of 50 KHz and the duty cycle is 50%, the efficiency is 11% higher than when the lamp is ignited at a commercial frequency.

It is known that the recent advance of transistorized ballasts has reached the point where the electrode loss due to a discharge is reduced 10% or more when a lamp is ignited by a commercially available ballast which produces a frequency on the order of 40 KHz.

Various studies have been made in an attempt to increase the efficiency of a system in which a low-pressure mercury vapor discharge lamp and an igniting device are combined. However, the present achievement is such that no substantial increase in efficiency has been accomplished.

SUMMARY OF THE INVENTION

It is an object of the present invention to provide a low-pressure mercury vapor discharge lamp device having a high efficiency.

The above object can be achieved by a discharge lamp composed of a phosphor-coated tubular discharge bulb having an inside diameter of 22 mm to 35 mm and an electrode-to-electrode distance of 400 mm to 1,200 mm and filled with a rare gas including Kr and a mercury vapor source sealed in the bulb, and an igniting device compound of a high-frequency power supply connected to a DC power supply for generating a substantially sinusoidal high-frequency output voltage having quiescent periods provided by a switch which is turned on and off at least once each half cycle to produce a substantially square wave high-frequency output voltage having rise and fall times of 2 μs or shorter.

Another object of the present invention is to provide a low-pressure mercury vapor discharge lamp device having an igniting device which consumes a reduced amount of electrical power, produces low noise, and is inexpensive to manufacture.

The last-mentioned object can be achieved by an igniting device comprising an inverter for converting rectified DC power into a substantially sinusoidal high-frequency voltage, a current-limiting impedance for controlling the current flowing through the discharge lamp, a switch device for controlling the quiescent periods of a voltage applied across the discharge lamp to produce a substantially square wave discharge lamp input voltage, and a control device for the switch device.

BRIEF DESCRIPTION OF THE DRAWINGS

FIG. 1(*b*) is a cross-sectional view of circular-bulb low-pressure mercury vapor discharge lamp device according to the present invention;

DETAILED DESCRIPTION OF THE PREFERRED EMBODIMENTS

Figure 1:
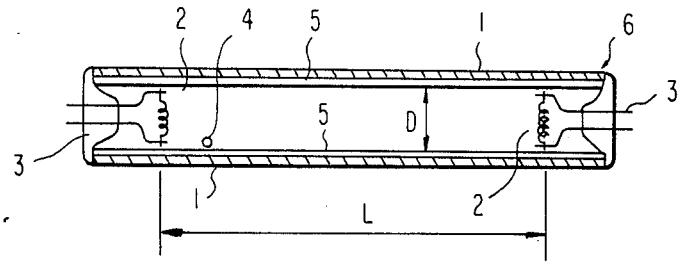
FIG. 1(*a*) is a longitudinal cross-sectional view of a straight-bulb low-pressure mercury vapor discharge lamp device according to the present invention.
Figure 1:
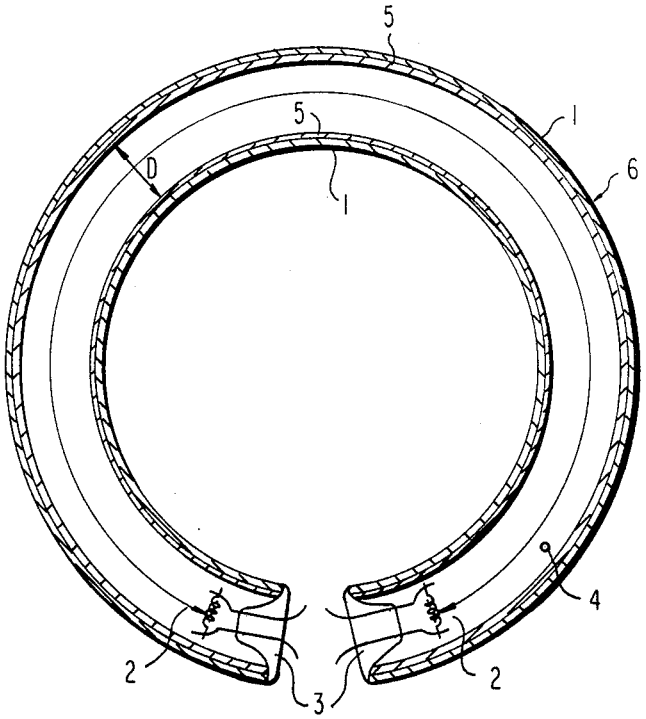

FIGS. 1(*a*) and 1(*b*) show low-pressure discharge lamps 6 each comprising a tubular bulb 1 made of quartz glass, soda glass, or lead glass, preheater electrodes 2 respectively disposed in opposite stems 3 of the bulb, and a mercury vapor source 4 in the form of about 25 mg of liquid mercury. A phosphor 5 is coated on the inner surface of the bulb at a density ranging from 4 to 7 mg/cm$^2$. A mixed gas of Kr and Ar is sealed in the bulb in a range that satisfies the following expressions (1) and (2):

$$X=X_1+X_2 \tag{1}$$

$$Y\geqq(21.54-0.94X_1-4.0X_1^2+1.39X_1^3-0.13X_1^4)X_1/X+(24.8-4.85X_2+3.51X_2^2-0.432X_2^2)X_2/X \tag{2}$$

in the ranges of $5\leqq Y\leqq 60$, $0.3\leqq X_1\leqq 5$, $0.3\leqq X_2\leqq 5$, where X is the total pressure (Torr) of the mixed gas, $X_1$ the partial pressure (Torr) of Ar, $X_2$ the partial pressure (Torr) of Kr, and Y the apparent temperature (°C.) of neutral plasma atoms.

Figure 2:
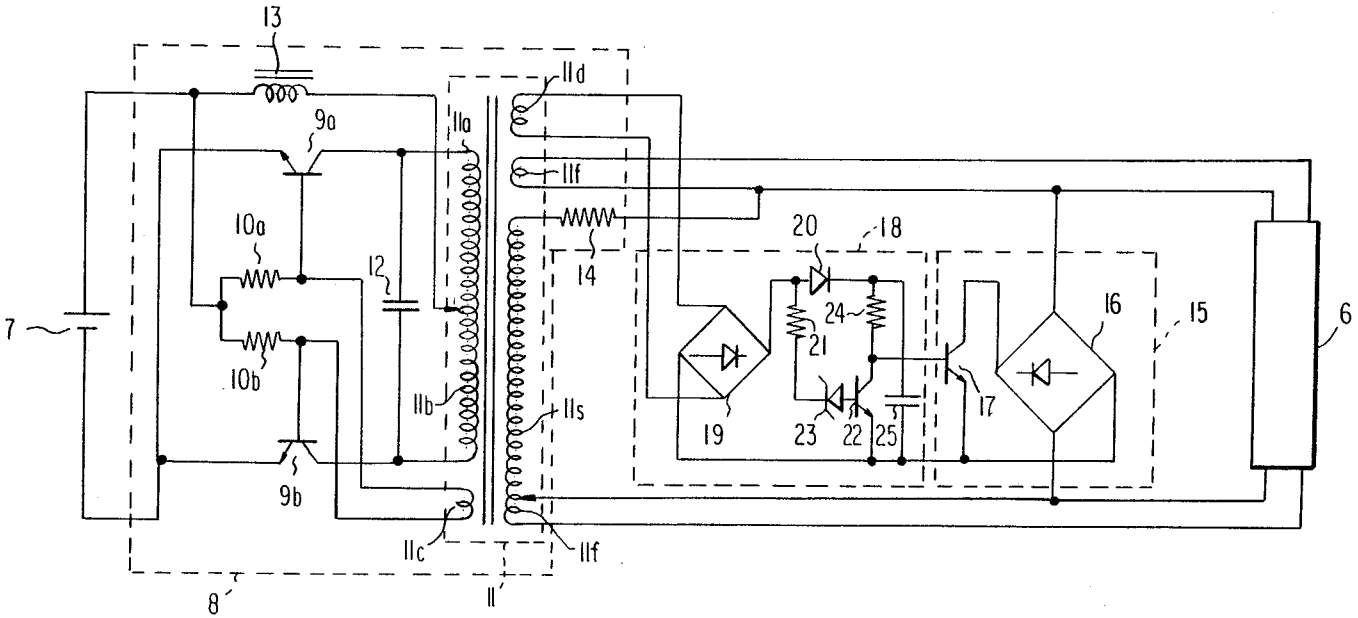
FIG. 2 is a circuit diagram of an igniting circuit according to the present invention.
Figure 3:
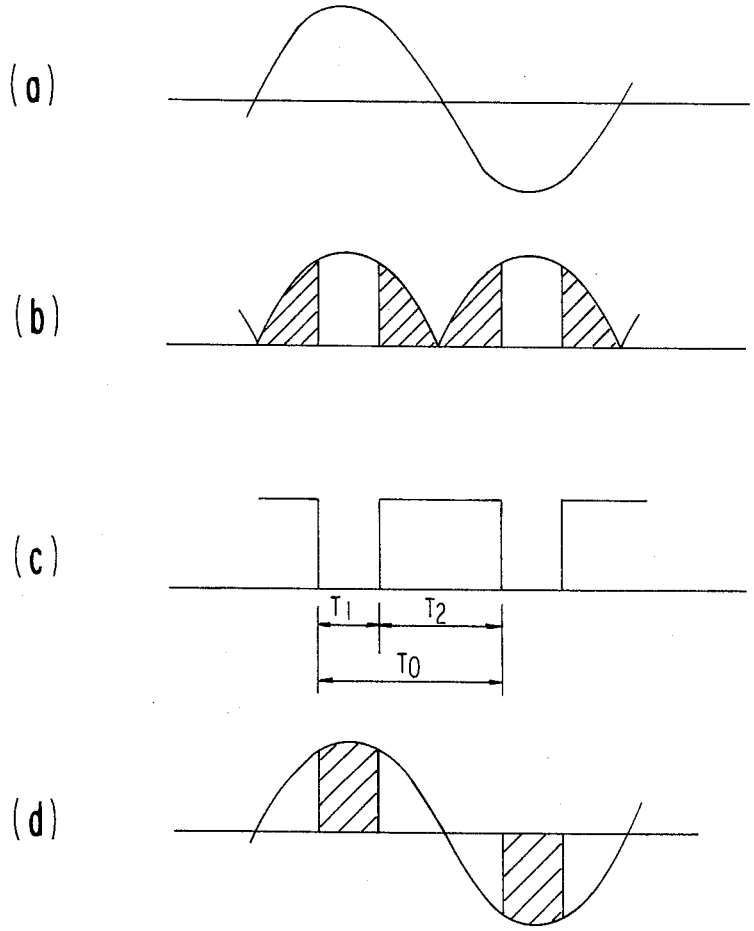
FIG. 3 is a diagram showing voltage waveforms illustrative of the operation of the igniting circuit.

FIG. 2 shows an igniting device, and FIG. 3 is a diagram of voltage waveforms during its operation. The igniting device has a DC power supply 7 which may be provided by rectifying a commercial AC power supply, and a high-frequency power supply device 8 for converting the DC voltage from the power supply into a substantially sinusoidal high-frequency voltage. The device 8 is composed of switching transistors 9*a*, 9*b*, resistors 10*a*, 10*b* connected respectively to the bases of the transistors, an output transformer 11 having primary windings 11*a*, 11*b*, a feedback winding 11*c*, a main secondary winding 11*s*, preheater secondary windings 11*f*, and a secondary power supply winding 11*d*, a resonance capacitor 12, a choke coil 13 serving as a current-limiting impedance, and a resistor 14 connected in series with the main secondary winding 11s. A switching device 15 comprises a full-wave rectifier circuit 16 and a switching transistor 17. The switching device 15 is controlled by a control device 18 composed of a full-wave rectifier circuit 19 for rectifying the output from the secondary power supply winding 11d, a reverse-current blocking diode 20, a resistor 21, a transistor 22, a zener diode 23 for maintaining a constant voltage, a resistor 24, and a smoothing capacitor 25. The switching device 15 and the control device 18 jointly constitute a quiescent period generator which is connected across the discharge lamp 6 for generating a quiescent period that occupies 15 to 85% of each half cycle.

When the temperature given by equation (2) with the equality sine employed is defined as Tc [critical temperature (°C.)], the O-Peak value Io−p (mA) of the discharge current is selected to be:

$$Io-p > 100 \text{ (mA)} \quad (3)$$

at a temperature of neutral plasma atoms $Y > Tc + 5$ (°C.).

When the discharge lamp is used in a special environment different from the conditions at which Ar and Kr were sealed in the bulb, the composition is in a range which does not meet expression (2), and the condition $-10 \leqq Y - Tc \leqq 5$ (°C.) is met, the discharge current is selected to be:

$$Io-p \geqq 43(Tc - Y) + 315 \text{ (mA)} \quad (4)$$

When the discharge lamp is used in the same special environment, the composition is in a range which does not meet expression (2), and the condition $Y < Tc - 10$ is met, the discharge current is selected to be:

$$Io-p > 745 \text{ (mA)} \quad (5)$$

The voltage applied across the low-pressure discharge lamp 6 is of a substantially square wave having rise and fall times of 2 μs or less.

When the high-frequency power supply device 8 generates a sine wave output as shown in FIG. 3(*a*), the control device 18 produces a signal to render the transistor 17 conductive during a period $T_2$ as illustrated in FIG. 3(*c*). The transistor 17 is thus energized in or during the hatched areas in FIG. 3(*b*), so that the discharge lamp 6 is supplied with high-frequency electrical power during periods $T_1$ corresponding to the hatched areas in FIG. 3(*d*).

Many examples of the foregoing construction were made with the inside diameter D of the lamp 6 being varied in the range of 22 mm to 35 mm, the electrode-to-electrode distance L varied in the range of 400 mm to 1,200 mm, a white phosphor used, and sealed rare gases prepared to meet expressions (1) and (2) above. The discharge lamps were measured using an igniting device capable of controlling the discharge current Io−p to meet expressions (3), (4) and (5) and a ballast for test use as specified by Japanese Industrial Standards (JIS).

Figure 5:
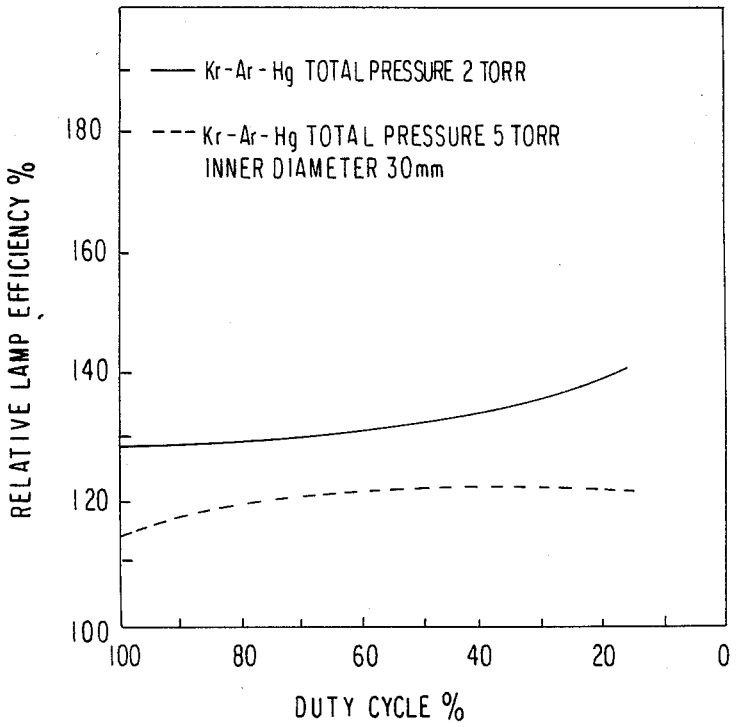
FIG. 5 is a graph showing the relationship between the duty cycle and the relative lamp efficiency.

FIG. 5 is a graph showing the relationship between a relative efficiency % of visible light and a duty cycle % when white fluorescent lamps having 30 mm inside diameter bulbs in which a mixed gas of Kr (20% or more by volume) and Ar is sealed under pressures of 2 Torr (solid line) and 5 Torr (broken line) are energized to meet the conditions of expressions (3) and (4) and to cause the duty cycle to meet the foregoing condition, with the lamp efficiency of a commercially available ballast being 100%.

No efficiency was confirmed below a duty cycle of 15% since the discharge was not sustained below that value.

It was confirmed from an experiment in which the apparent temperature Y (°C.) of neutral plasma atoms was varied in the range of $5 \leqq Y \leqq 60$ that a stable discharge with no moving striations in the positive column could be sustained by a discharge current of Io−p or greater than the solid line in FIG. 5 for each temperature. The generation of moving striations is thus affected by the discharge current Io−p (limit current). When the electrical power supplied is kept constant due to practical limitations according to the present invention, a discharge current Io−p having quiescent periods can be higher than currents having the same effective value, resulting in a reduced tendency to produce moving striations.

Although the relative radiation efficiency of visible light is increased as the duty cycle is reduced as shown in FIG. 5, the discharge disappears when the duty cycle reaches 15% or less.

Figure 6:
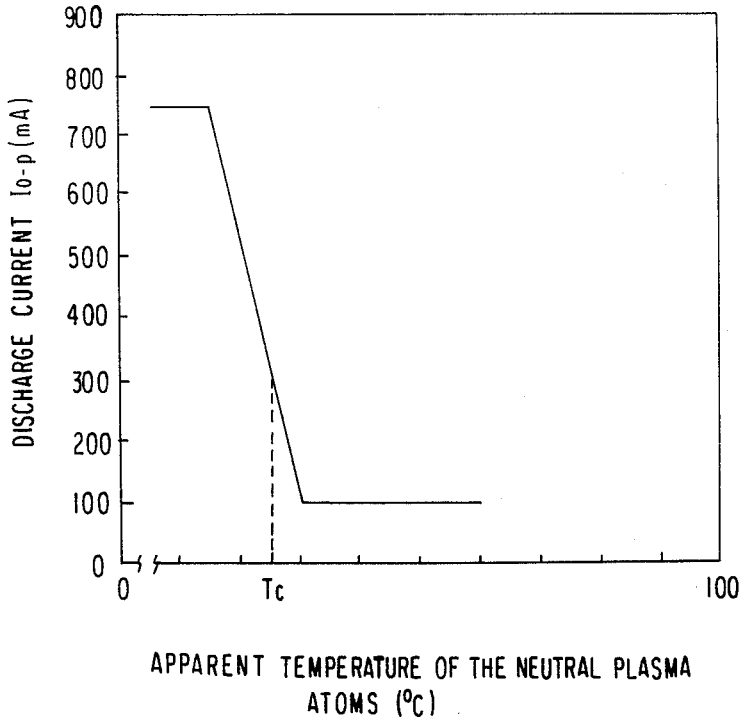
FIG. 6 is a graph explanatory of a limit current for producing a moving striation on the basis of the apparent temperature of neutral plasma atoms and a discharge current Io−p.

The above tendency remains the same as long as a rare gas containing Kr is used. However, it was necessary that the peak value Io−p (mA) of the discharge current meet expressions (3), (4) and (5) in order to prevent moving striations from being produced dependent on the pressure and kind of the sealed rare gas and to keep a certain discharge efficiency. FIG. 6 is a simple diagram explanatory of expressions (3), (4) and (5). The position of the straight line in FIG. 6 is determined by the critical temperature which is governed by the sealed gas composition.

Figure 4:
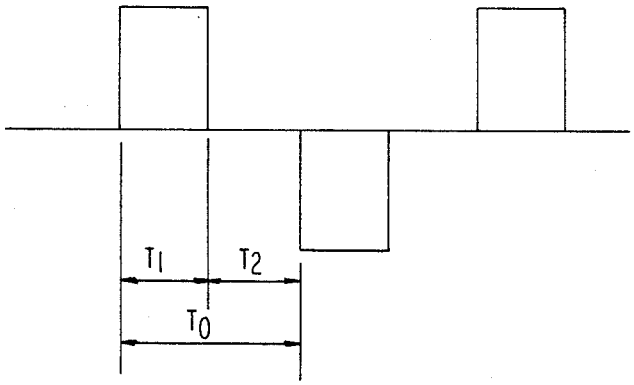
FIG. 4 is a diagram showing an ideal voltage waveform.

It is clear that the concept of the present invention can be achieved by employing an inductive reactance such as the current-limiting impedance 13 in the high-frequency power supply 8 in the igniting device. With such an arrangement, the control device 18 should generate a turn-on signal during a period in which the output current from the high-frequency power supply 8 is low. FIG. 4 illustrates an ideal high-frequency power output waveform in which $T_1$ denotes an application period, $T_2$ a quiescent period, and $T_0$ a half cycle period.

When a 40 W rapid-start fluorescent lamp 6 having a white-phosphor-coated bulb containing a mixed rare gas of Kr—Ar—Hg under a total pressure of 2 Torr with Ar having a volume fraction of 50% at 20° C. was ignited by the device shown in FIG. 2, the voltage applied between the electrodes was a substantially square wave. The duty cycle selected was 40%.

The fluorescent lamp 6 was tested by lighting it within an integrating-sphere photometer controlled in an atmosphere of 25±1° C. and no air movement. After the lamp had reached a steady state, the values of the luminous flux and the electrical power were measured.

A white-phosphor fluorescent lamp having a 34 mm inside bulb diameter and a length of JIS 40 W with a mixed gas of Kr—Ar—Hg sealed under a total pressure of 2.3 Torr with 20% by volume of Kr was energized at a frequency of 20 KHz, a duty cycle of 70%, a discharge current having an effective value of 350 mA, and an ambient temperature of 25° C. (the apparent temperature of neutral plasma atoms being 40° C.). The radiation efficiency of visible light emitted from the lamp ignited under the above conditions was about 32% higher than when the lamp was ignited by a 40 W rapid-start ballast for test use at 50 Hz and 300 V.

A white-phosphor fluorescent lamp having a 26 mm inside bulb diameter and a length of JIS 40 W with a mixed gas of Kr—Ar—Hg sealed under a total pressure of 3 Torr with 30% by volume of Ar was energized at a frequency of 40 KHz, a duty cycle of 20%, a discharge current having an effective value of 250 mA, and an ambient temperature of 25° C. (the apparent temperature of neutral plasma atoms being 40° C.). The radiation efficiency of visible light emitted from the lamp ignited under the above conditions was about 21% higher than when the lamp was ignited by a 40 W rapid-start ballast for test use at 50 Hz and 200 V.

Thereafter, a white-phosphor fluorescent lamp having a 34 mm inside bulb diameter and a length of JIS 40 W with a mixed gas of Kr—Ar—Hg sealed under a total pressure of 1.8 Torr with 50% by volume of Kr was energized at a frequency of 20 KHz, a duty cycle of 30%, a discharge current having an effective value of 420 mA, and an ambient temperature of 25° C. (the apparent temperature of neutral plasma atoms being 40° C.). The radiation efficiency of visible light emitted from the lamp ignited under the above conditions was about 36% higher than when the lamp was ignited by a 40 W rapid-start ballast for test use at 50 Hz and 200 V.

While in the above examples the igniting device generated frequencies of 10 KHz or higher with a duty cycle ranging from 15 to 85%, for commercial use the igniting device should desirably produce frequencies of about 17 KHz or higher to prevent the power supply 8 from emanating undesirable audible noise. Where a bipolar transistor was used to reduce the switching loss in the quiescent period generator, the upper frequency limit was 100 KHz for best results.

Figure 7:
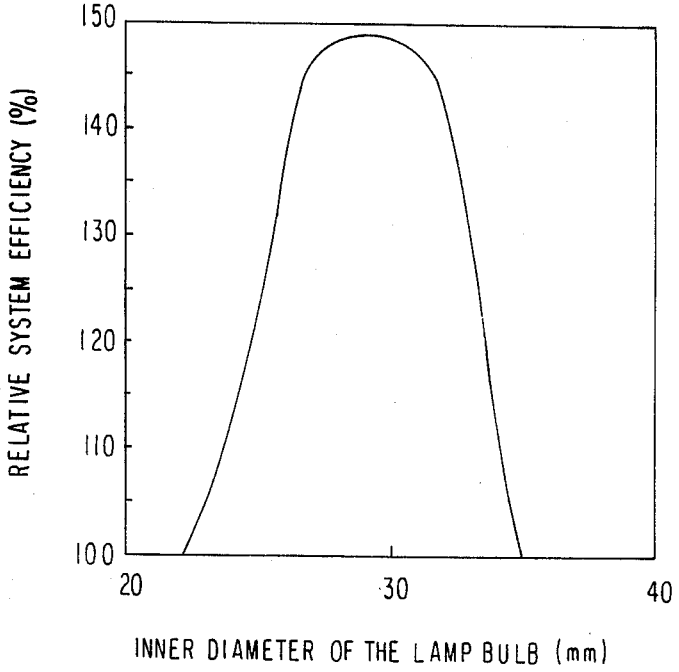
FIG. 7 is a graph showing relative system efficiency.

FIG. 7 is a graph showing the relationship between the system radiation efficiency at a wavelength of 253.7 nm and the discharge bulb inside diameter at 25° C. when the partial pressure of the Kr in the lamp ranged from 0.2 Torr to 3 Torr. The system efficiency of 100% in FIG. 7 means the value obtained when a general fluorescent lamp was energized by a commercially available ballast. The lamp was ignited at a frequency of 20 KHz. FIG. 7 is illustrative of results obtained when $T_2 > T_1$ in FIG. 3. Where the quiescent period $T_2$ is selected to range between 2 μs and 30 μs dependent on the buffer gas in view of the life of metastable atoms, the efficiency of radiation at 253.7 nm generated in a half discharge period is increased.

The rare gas Kr in particular exhibited its best effect when its partial pressure ranged from 0.2 Torr to 3 Torr. Therefore, a high system efficiency could be obtained by sealing Kr in the above range and igniting the lamp at a high frequency having the foregoing quiescent period.

The phosphor coated on the inner surface of the bulb 1 should comprise a compound which will radiate light in three wavelength ranges of 445 nm to 475 nm inclusive, 525 nm to 555 nm inclusive, and 595 nm to 625 nm inclusive, when an ultraviolet ray is applied to the phosphor, and which has a spectral distribution such that the sum of the three radiation energies is 45% or more of the energy in the range from 380 nm to 780 nm. More specifically, the phosphor may comprise $Y_2O_3:Eu^{3+}$, $LaPO_4:Ce^{3+}$, $Tb^{3+}$, $(Sr,Ba)_9(PO_4)_6SrCl_2:Eu^{2+}$ added at a weight ratio of 30:49:21, or $Ca_3(PO_4)_2Ca(F.Cl)_2:Sb^{3+}$, $Mn^{2+}$. The above phosphor has a highly increased efficiency of converting ultraviolet radiation into visible light due to its response characteristics with respect to ultraviolet radiation.

A discharge lamp with such a three-wavelength-range phosphor coated on a bulb of quartz having an inside diameter of 30 mm and a length of JIS 40 W was energized by a ballast for test use at 50 Hz and 200 V while the bulb was placed in a water stream flowing at a rate of about 8 l/min. with a view to confirming an increased ultraviolet conversion efficiency. In addition, the lamp was energized by a high-frequency voltage at a frequency ranging from 1 KHz to 100 KHz and a duty cycle ranging from 15% to 85% for efficiency comparison. When the duty cycle was changed, the light generation efficiency (1 m/W) of the three-wavelength-range phosphor was greater than when a continuous discharge waveform was applied.

Figure 8:
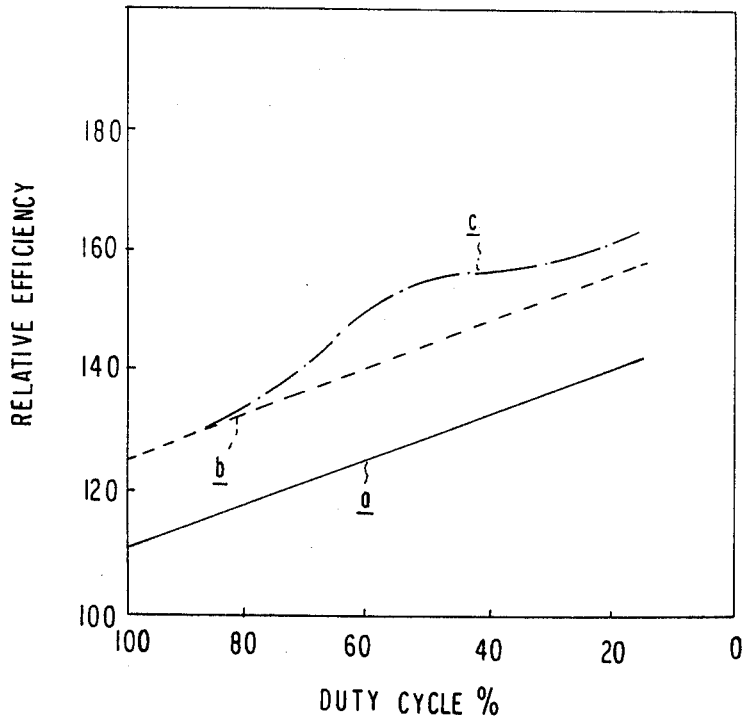
FIG. 8 is a graph illustrative of the relative efficiencies of a three-wavelength-range phosphor and a white phosphor plotted against a duty cycle.

FIG. 8 shows the relationship between the duty cycle and the relative efficiency. The ordinate axis is indicative of the relative visible light generation efficiency with the lamp efficiency (1 m/W) of a white fluorescent lamp sealing an Ar—Kr—Hg gas under a pressure of 2 Torr being 100 when the lamp was ignited at a commercial frequency, and the abscissa axis is representative of the duty cycle (%).

The solid line a in FIG. 8 indicates the relative efficiency corresponding to the duty cycle of a discharge lamp employing a white phosphor, and the dot-and-dash line c represents a variation in the relative efficiency corresponding to the duty cycle of a discharge lamp using a three-wavelength-range phosphor. It was confirmed that the three-wavelength-range phosphor had a 5%–10% higher quantum conversion efficiency due to the effect of the duty cycle than the broken line b indicative of an ordinary efficiency change.

As shown in FIG. 8, the visible light relative radiation efficiency is increased as the duty cycle is reduced. The discharge disappears when the duty cycle reaches 15% or less. According to the technology presently available, therefore, an increase in the quantum conversion efficiency of the three-wavelength-range phosphor has been confirmed in the duty cycle range of from 85% to 15%.

The same advantages as those of FIG. 8 can be achieved by all three-wavelength-range phosphors which will radiate light in the three wavelength ranges set forth above when an ultraviolet ray is applied to the phosphors, and which have a spectral distribution such that the sum of the three radiation energies is 45% or more of the energy in the range from 380 nm to 780 nm.

A 40 W rapid-start fluorescent lamp 6 having an inside bulb diameter D of 30 mm coated with a phosphor comprising $Y_2O_3:Eu^{3+}$, $LaPO_4:Ce^{3+}$, $Tb^{3+}$, $(Sr,Ba)_9(PO_4)_6SrCl_2:Eu^{2+}$ added at a weight ratio of 30:49:21, with a mixed rare gas of Kr—Ar—Hg sealed in the bulb at a total pressure of 2 Torr with Ar having a volume fraction of 50% at 20° C., was continuously energized by the igniting device shown in FIG. 2 with a rectangular wave. After the lamp had reached a steady state, the luminous flux and electrical power were measured. The lamp was then ignited at a duty cycle of 40%, and the luminous flux and electrical power were again measured after the lamp had reached a steady state. The relative efficiency of the lamp light output was about 7% higher than the ratio at the duty cycle of 40% predicted from the relative efficiency of continuous energization with a square wave.

With the same phosphor and bulb dimensions as those in the example above employed, Kr and Ne were sealed in the 40 W fluorescent lamp 6 at a mixture mol ratio of 6:4 under a pressure of 1.8 Torr. The lamp was energized at a duty cycle of 50% as shown in FIG. 4 ($T_0$ is 10 μs, and $T_1$ is 5 μs) with a current having an effective value of 0.35 A. As a result of the same comparison as that in the above example, a relative efficiency 10% higher than predicted was obtained.

The same phosphor as that in the above example was then used, and a mixed rare gas of 20% by volume of Kr, 5% by volume of Xe, and 75% by volume of Ne was sealed under 2 Torr in the bulb of a 40 W fluorescent lamp 6 having an inside diameter of 29 mm. The lamp was energized at a duty cycle of about 43% ($T_1$ is 3 μs, and $T_0$ is 7 μs) with a current having an effective value of 0.23 A. As a result of the same comparison as that in the above example, a relative efficiency 8% higher than predicted was obtained.

Thereafter, the same phosphor as in the above example was used, and a mixed rare gas of 20% by volume of Kr and 80% by volume of Ar was sealed under 2.5 Torr in the bulb of a 20 W fluorescent lamp 6 having an inside diameter of 25 mm. The lamp was energized at a duty cycle of about 40% ($T_1$ is 5 μs, and $T_0$ is 12.5 μs) with a current having an effective value of 0.32 A. As a result of the same comparison as that in the above example, a relative efficiency 5% higher than predicted was obtained.

In the above examples, an extremely high radiation efficiency at 253.7 nm could be achieved by limiting the quiescent period to an interval (5 μs through 30 μs) shorter than the average effective quench life of a shift from the level $6^3P_1$ to the level $6^1S_0$ due to the life of mercury atoms in the levels $6^3P_2$ and $6^3P_0$. By selecting rise and fall times of the waveform of electrical power supplied to the discharge lamp to be less than 2 μs, the electron temperature could be raised at the time of supplying electrical power and the radiation efficiency at 253.7 nm could be increased. Furthermore, by providing a quiescent period after a sharp voltage drop, the average electron temperature could be lowered, the collision loss due to an increase in the mercury vapor density could be reduced, and the radiation efficiency at 253.7 nm could be increased.

High-frequency lamp ignition generally suffers from a phenomenon such that the discharge becomes unstable beyond a limit current as seen in a DC discharge as proposed by W. Pupp (Phys z33 844 (1932)), and also from a phenomenon such that the discharge becomes unstable beyond a critical temperature (since mercury vapor pressure is dependent on the ambient temperature) corresponding to an inherent critical composition dependent on the ratio of a mercury vapor mol number and a total mol number of a rare gas in commercial frequency AC energization as proposed by T. Kajiwara (J. Light & Vis. Evn 5(2) 11–18 (1981)). Therefore, dependent on the ambient temperature and the total mol number of a sealed rare gas (under total pressure ranging from 1 Torr to 5 Torr), the peak value of the discharge current was controlled in the range of from 100 mA to 1000 mA in the above examples so that the discharge would not be unstable (or not suffer from moving striations).

The background or basis for introducing expressions (1), (2), (3) and (4) above will now be described.

Moving striations are believed to be caused by (i) the relationship between the ambient temperature and the gas pressure and (ii) the relationship between the discharge current and the gaps pressure. With respect to the former relationship, it has been reported in J. Light & Vis. Evn., Vol 5, No. 2, 1981 that (a) for a single-rare-gas-and-mercury-vapor lamp, the temperature (critical temperature) at which moving striations are produced varies with the pressure of the sealed rare gas, and the relationship between the critical temperature and the gas pressure is expressed by a polynomial at the time a correlation coefficient is close to 1 through a higher-order least square approximation based on experimental data. With respect to the latter relationship, it has been reported in Japan Electrotechnical Committee research material LAV-82-49 that (b) when the ambient temperature drops below a critical temperature the mercury vapor pressure is lowered, and a limit current close to the following equation concerning the limit current and the rare-gas sealing pressure and related to the DC discharge which W. Pupp introduced in Phys. z33 844 (1932):

$$I = CP^{-r}$$

where C and r are constants, I is the current value, and P is the sealing pressure, is observed in a discharge at a commercial frequency.

For a mixed-rare-gas-and-mercury-vapor lamp, LAV-82-49 and IES 182 Ann. Tech. Report has reported that (c) the additive property of rare gases (distributive property due to molar fractions) is established in relation to the relationship between the critical temperature and the partial pressures of the gases.

On the assumption, according to the present invention, that the critical temperature for the mixed rare gas could be determined by introducing molar fractions into the polynomial in (a) above, the expression (1) and (2) have been derived from (a) and (c) above, the expressions (3) and (4) have been derived from (b) above, and, particularly, the coefficients in expression (2) have been determined through simulation in view of (a) and (b) above.

While in the above examples the quantum conversion efficiency of ultraviolet radiation radiated in straight bulbs by the igniting device of the invention has been described with respect to the white phosphor and three-wavelength-range phosphor, the same results were obtained from circular discharge bulbs as those described above.

What is claimed is:

1. A low-pressure mercury vapor discharge lamp, comprising:

(a) a tubular bulb (1) having an inside diameter of between 22 mm and 35 mm, end electrodes (2) spaced apart by a distance of between 400 mm and 1,200 mm, an inner surface coated with a phosphor (5), and a mercury vapor source (4) and a rare gas including Kr sealed within said tubular bulb; and (b) an igniting device having a high-frequency power supply (8) connected to a DC power supply (7) for generating a substantially sinusoidal high-frequency output voltage, and a switch (17) connected to said high-frequency power supply and turned on and off at least once in each half cycle of the high-frequency output voltage to provide a quiescent period in each half cycle to thereby produce a substantially square wave high-frequency output voltage having rise and fall times of 2 μs or less, and means for applying said substantially square wave high-frequency output voltage to said end electrodes to energize the lamp.

2. A discharge lamp according to claim 1, wherein said Kr has a partial pressure ranging from 0.2 Torr to 3 Torr.

3. A discharge lamp according to claim 1, wherein said phosphor comprises a compound which will absorb ultraviolet radiation and radiate visible light in three wavelength ranges of from 445 nm to 475 nm inclusive, from 525 nm to 555 nm inclusive, and from 595 nm to 625 nm inclusive, and which has a spectral distribution such that the sum of the three radiation energies is 45% or more of the energy in the range from 380 nm to 780 nm.

4. A discharge lamp according to claim 1, wherein said substantially square wave high-frequency output voltage generated by said igniting device has a frequency of 1 KHz or higher, and a quiescent period which occupies between 15% and 85% of a half cycle, and wherein a lamp discharge current has a peak value ranging from 100 to 1,000 mA.

5. A discharge lamp according to claim 3, wherein said compound includes a phosphor composed of yttrium as a base material and trivalent europium added thereto.

6. A discharge lamp according to claim 1, wherein said rare gas sealed in said bulb is sealed under a pressure ranging from 1 Torr to 5 Torr and comprises a mixture of Kr and one of Ne, Ar and Xe or a mixture of Ne, Ar and Xe.

7. A discharge lamp according to claim 1, wherein said rare gas comprises a mixed gas of Kr and Ar and is sealed to satisfy the following expressions:

$$X = X_1 + X_2 \quad (1)$$

$$Y \geqq (21.54 - 0.94X_1 - 4.0X_1^2 + 1.39X_1^3 - 0.13X_1^4)X_1/X + (24.8 - 4.85X_2 + 3.51X_2^2 - 0.432X_2^2)X_2/X \quad (2)$$

in the ranges of $5 \leqq Y \leqq 60$, $0.3 \leqq X_1 \leqq 5$, $0.3 \leqq X_2 \leqq 5$, where X is the total pressure (Torr) of the mixed gas, $X_1$ the partial pressure (Torr) of Ar, $X_2$ the partial pressure (Torr) of Kr, and Y the apparent temperature (°C.) of neutral plasma atoms, said substantially square wave high-frequency voltage generated by said igniting device having a frequency of 10 KHz or higher and a quiescent period which occupies between 15% and 85% of a half cycle, and where the temperature given by expression (2) with the equality sign employed is defined as Tc [critical temperature (°C.)], the O-Peak value Io−p (mA) of the lamp discharge current being selected to be:

$$Io-p > 100 \text{ (mA)} \quad (3)$$

at $Y > Tc + 5$ (°C.), $$Io-p \geqq 43(Tc - Y) + 315 \text{ (mA)} \quad (4)$$

at $-10 \leqq Y - Tc \leqq 5$ (°C.), and $$Io-p > 745 \text{ (mA)} \quad (5)$$

at $Y < Tc - 10$.

* * * * *